US010420433B2

(12) United States Patent
Coon et al.

(10) Patent No.: US 10,420,433 B2
(45) Date of Patent: Sep. 24, 2019

(54) NO-SPILL DRINKING CONTAINER

(71) Applicant: IGNITE USA, LLC, Chicago, IL (US)

(72) Inventors: Robert C. Coon, Chicago, IL (US); Paul D. Hurley, Libertyville, IL (US)

(73) Assignee: IGNITE USA, LLC, Chicago, IL (US)

( * ) Notice: Subject to any disclaimer, the term of this patent is extended or adjusted under 35 U.S.C. 154(b) by 258 days.

(21) Appl. No.: 15/060,227

(22) Filed: Mar. 3, 2016

(65) Prior Publication Data

US 2017/0251850 A1 Sep. 7, 2017

(51) Int. Cl.

| | |
|---|---|
| ***A47G 19/22*** | (2006.01) |
| ***A47G 21/18*** | (2006.01) |
| ***B65D 47/32*** | (2006.01) |
| ***B65D 51/00*** | (2006.01) |

(52) U.S. Cl.

CPC ..... *A47G 19/2272* (2013.01); *A47G 19/2266* (2013.01); *A47G 21/18* (2013.01); *B65D 47/32* (2013.01); *B65D 51/002* (2013.01); *B65D 2205/02* (2013.01); *B65D 2231/022* (2013.01)

(58) Field of Classification Search

CPC ..... A47G 21/18; A47G 19/2222; B65D 2543/00046; B65D 47/06; B65D 47/066; B65D 47/2031; B65D 2517/0049; B65D 47/32; B65D 2231/022

USPC ..... 220/212, 702, 709

See application file for complete search history.

(56) References Cited

U.S. PATENT DOCUMENTS

| | | | | |
|---|---|---|---|---|
| 4,196,747 | A * | 4/1980 | Quigley | A47G 19/2222 137/527.8 |
| 5,186,347 | A | 2/1993 | Freeman et al. | |
| 5,381,924 | A | 1/1995 | Kiefel | |
| 5,560,513 | A | 10/1996 | Jarrell et al. | |
| 6,523,711 | B1 | 2/2003 | Hughes et al. | |
| 6,793,075 | B1 | 9/2004 | Jeter et al. | |
| RE38,692 | E | 2/2005 | Wong | |
| 6,887,614 | B2 * | 5/2005 | Duprey | H01M 2/0421 429/185 |
| 6,929,135 | B1 | 8/2005 | Hajianpour | |
| D517,913 | S | 3/2006 | Mouyos | |
| 7,222,759 | B2 | 5/2007 | Bunn et al. | |
| 7,546,933 | B2 | 6/2009 | Pinelli | |

(Continued)

FOREIGN PATENT DOCUMENTS

| | | |
|---|---|---|
| CN | 101605483 A | 12/2009 |
| CN | 102730296 A | 10/2012 |
| CN | 104870330 A | 8/2015 |

OTHER PUBLICATIONS

U.S. Appl. No. 15/060,580, filed Mar. 3, 2016, Matthis.

(Continued)

*Primary Examiner* — Shawn M Braden

(74) *Attorney, Agent, or Firm* — Marshall, Gerstein & Borun LLP

(57) ABSTRACT

A liquid container lid assembly includes a straw having an internal one-way valve and a grommet seal for sealing against the straw. As a result, the disclosed liquid container lid assembly allows a consumer (such as a child) to drink from the straw while preventing accidental spillage without the need for the child to manipulate any part of the lid assembly (such as a lock or valve release). In other words, the liquid container lid assembly is always in a no-spill configuration while simultaneously allowing a consumer to drink from the straw.

18 Claims, 5 Drawing Sheets

(56) References Cited

U.S. PATENT DOCUMENTS

| | | | | |
|---|---|---|---|---|
| 7,934,620 | B2 | 5/2011 | Stribling et al. | |
| 7,972,064 | B2 | 7/2011 | Anderson | |
| 7,997,442 | B2 | 8/2011 | Pinelli | |
| 8,118,182 | B1 | 2/2012 | Licari | |
| 8,186,537 | B2 * | 5/2012 | Rosnak | A47G 19/2266 220/705 |
| 8,328,113 | B2 | 12/2012 | Stribling et al. | |
| 8,342,422 | B2 | 1/2013 | Claessens | |
| 8,403,164 | B2 | 3/2013 | Samson | |
| 8,464,896 | B2 | 6/2013 | Beary | |
| 8,505,767 | B2 | 8/2013 | Giraud et al. | |
| 8,590,731 | B2 | 11/2013 | Pinelli | |
| 8,622,236 | B2 * | 1/2014 | Sanbrook | A47G 19/2266 215/388 |
| 8,684,201 | B2 | 4/2014 | Berkovitch et al. | |
| 8,931,634 | B2 | 1/2015 | Anderson | |
| 8,967,412 | B2 | 3/2015 | Loging | |
| 9,079,205 | B2 | 7/2015 | Hoskins | |
| 9,095,233 | B2 | 8/2015 | Pinelli | |
| 9,138,088 | B2 * | 9/2015 | Kemper | A47G 19/2272 |
| D740,605 | S | 10/2015 | Wodka et al. | |
| 9,149,138 | B2 | 10/2015 | Miller | |
| D742,684 | S | 11/2015 | Hurley et al. | |
| 9,241,588 | B2 | 1/2016 | Dunn et al. | |
| 9,398,823 | B2 | 7/2016 | Pinelli | |
| 2005/0167437 | A1 * | 8/2005 | Struckmeier | A47G 19/2266 220/705 |
| 2005/0167438 | A1 | 8/2005 | Minyayev et al. | |
| 2005/0205589 | A1 | 9/2005 | Davis et al. | |
| 2007/0062943 | A1 * | 3/2007 | Bosworth | B65D 43/02 220/212 |
| 2009/0188929 | A1 | 7/2009 | Sims et al. | |
| 2011/0049169 | A1 | 3/2011 | Rosnak et al. | |
| 2011/0198349 | A1 * | 8/2011 | Lane | A47G 19/2272 220/203.04 |
| 2012/0031917 | A1 | 2/2012 | Loging | |
| 2012/0261416 | A1 * | 10/2012 | Lin | B65D 43/0229 220/253 |
| 2014/0103041 | A1 | 4/2014 | Randolph et al. | |
| 2014/0117030 | A1 | 5/2014 | Milan | |
| 2014/0251939 | A1 | 9/2014 | Boonprasop | |
| 2015/0060448 | A1 | 3/2015 | Coon et al. | |
| 2015/0157151 | A1 | 6/2015 | Rohrig | |

OTHER PUBLICATIONS

U.S. Appl. No. 15/061,312, filed Mar. 4, 2016, Coon et al.
U.S. Appl. No. 15/192,893, filed Jun. 24, 2016, Pinelli.
U.S. Appl. No. 29/556,997, filed Mar. 4, 2016, Stover et al.
U.S. Appl. No. 29/557,014, filed Mar. 4, 2016, Stover et al.
U.S. Appl. No. 29/557,030, filed Mar. 4, 2016, Stover et al.
U.S. Appl. No. 62/303,942, filed Mar. 4, 2016, Boyer et al.
Bubba 24 oz Envy Tumbler, downloaded from the Internet at: <https://www.shopbubba.com/shop-all/tumblers/bubba-24-oz-envy-tumbler-fresh-onyx/.
Hydrate, Bubba Brands, Inc., 24oz Envy Tumbler, downloaded from the Internet at: <http://www.bubbabrands.com/product/hydrate-24oz-envy/>.
Chinese Patent Application No. 201710124715.1, Office Action, dated Jul. 24, 2019.

* cited by examiner

NO-SPILL DRINKING CONTAINER

FIELD OF THE DISCLOSURE

The disclosure relates generally to a lid assembly for liquid containers, and more particularly, to a re-closable lid assembly for liquid containers, the re-closable lid assembly allowing a consumer to drink through a straw from the liquid container while preventing accidental spills.

BACKGROUND

Refillable beverage containers, such as commuter coffee mugs, for example, typically include a removable lid that includes a fluid aperture or drink hole, and a consumer typically fills the interior of the container (e.g., an insulated container) with a beverage (e.g., coffee) when the lid is removed. To drink the beverage, the consumer typically tips the container to allow the beverage to pass through the drink hole, and the consumer sips the beverage as the beverage exits the drink hole.

In some cases, a simple drink hole may be undesirable as a consumer (such as a young child or toddler) may not be sufficiently skilled to drink from the hole while not spilling. To address this problem, beverage containers with spouts were developed. Such containers include a flip out spout with a ball joint element. When the spout is flipped out in a drinking position, the ball joint is open, allowing liquid to flow out of the container through the spout. When drinking is no longer desired, the spout must be flipped to a closed position, thereby closing the ball joint and preventing liquid from flowing out of the container. Thus, such beverage containers for children are either in the drink mode or the non-spill mode.

Other drink containers may include a straw that is manually stored in a crimped position when not in use to prevent spills. Similar to the ball joint products described above, these containers are either in the drink configuration, in which the straw is not crimped, or in the no-spill configuration, in which the straw is crimped. In any event, the user must manipulate some portion of known drink containers to transition the container between the drink configuration and the no-spill configuration.

BRIEF SUMMARY OF THE DISCLOSURE

A liquid container lid assembly includes a straw having an internal one-way valve and a grommet seal for sealing against the straw. As a result, the disclosed liquid container lid assembly allows a consumer (such as a child) to drink from the straw while preventing accidental spillage without the need for the child to manipulate any part of the lid assembly (such as a lock or valve release). In other words, the liquid container lid assembly is always in a no-spill configuration while simultaneously allowing a consumer to drink from the straw.

DETAILED DESCRIPTION

Figure 1:
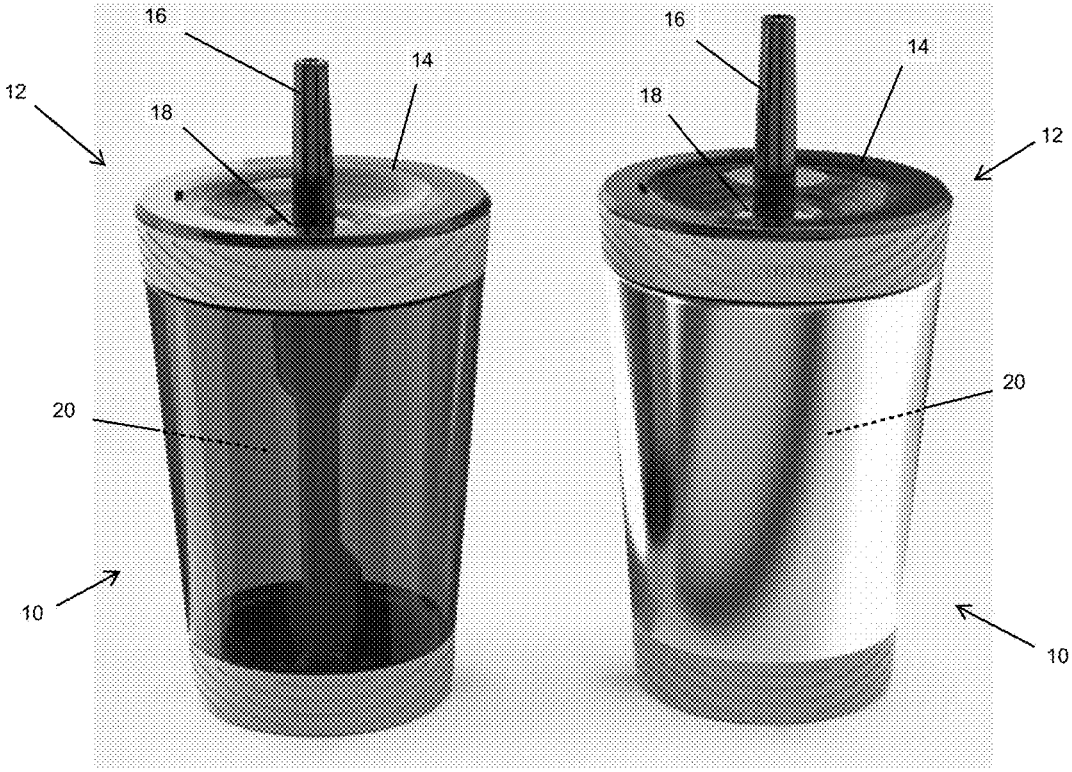
FIG. 1 is a perspective view of two containers having a lid assembly constructed in accordance with the disclosure.

Turning now to FIG. 1, a container 10 includes a lid assembly 12 that is removably attached to the container 10. The lid assembly 12 includes a cover 14 and a straw 16. The lid 12 seals the contents of the container 10 from outside elements. The straw 16 is disposed in an opening 18 in the cover 14, a portion of the straw 16 being located within an interior 20 of the container 10 and a portion of the straw 16 being located outside the interior 20 of the container.

Generally, the lid assembly 12 includes a no-spill mechanism that prevents accidental spillage from the container 10 while allowing a consumer (e.g., a child) to drink from the straw without the need to manipulate any part of the lid assembly 12. In other words, the lid assembly 12 simultaneously allows fluid to flow in one direction from the container 10 out of the straw 16 when a child is drinking and the lid assembly 12 prevents accidental spillage by preventing fluid flow out of the straw 16 (or out of the opening 18) when the child is not drinking with no manipulation of the lid assembly 12 required.

Figure 2:
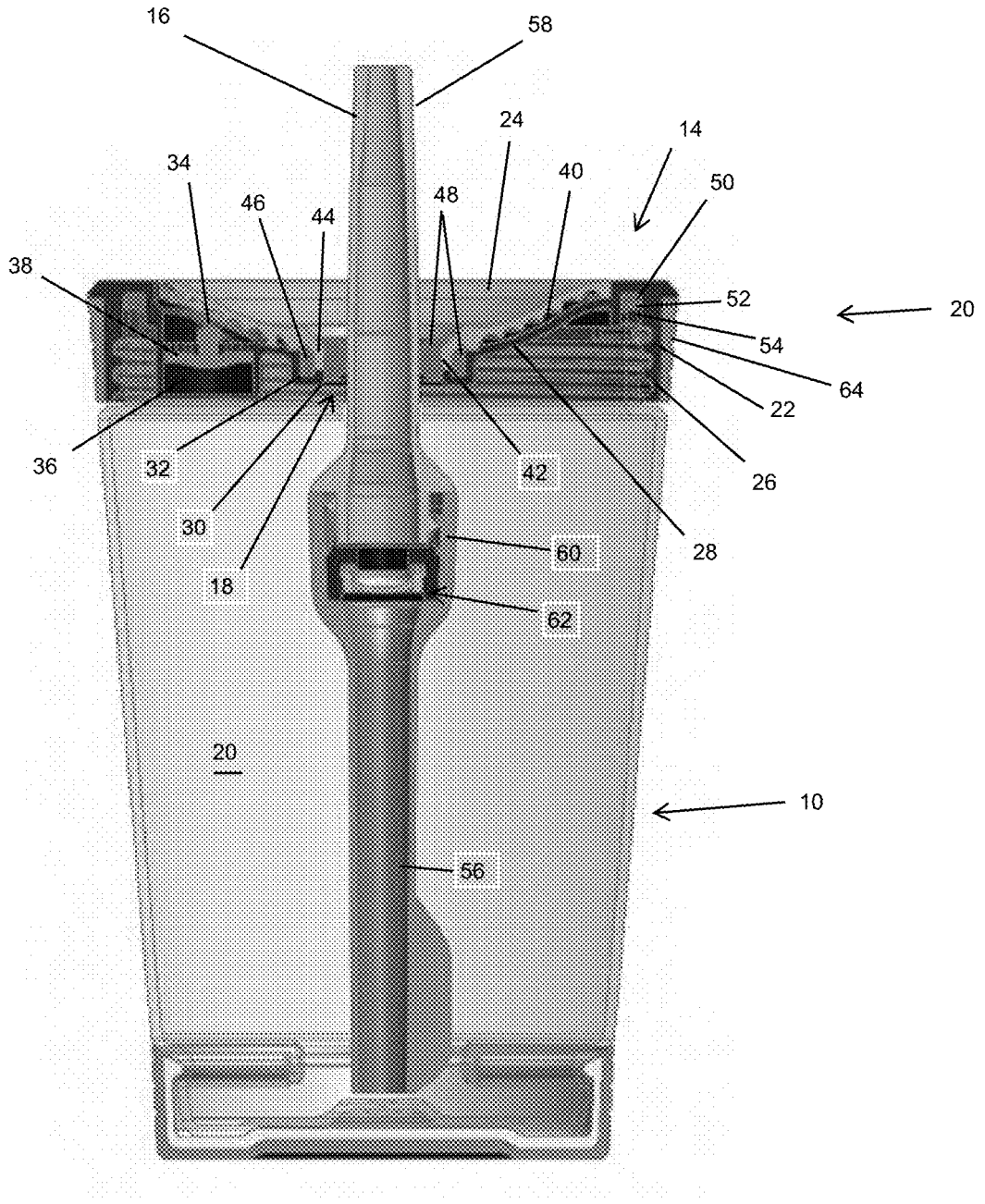
FIG. 2 is a cross-sectional view of one of the containers of FIG. 1.
Figure 3:
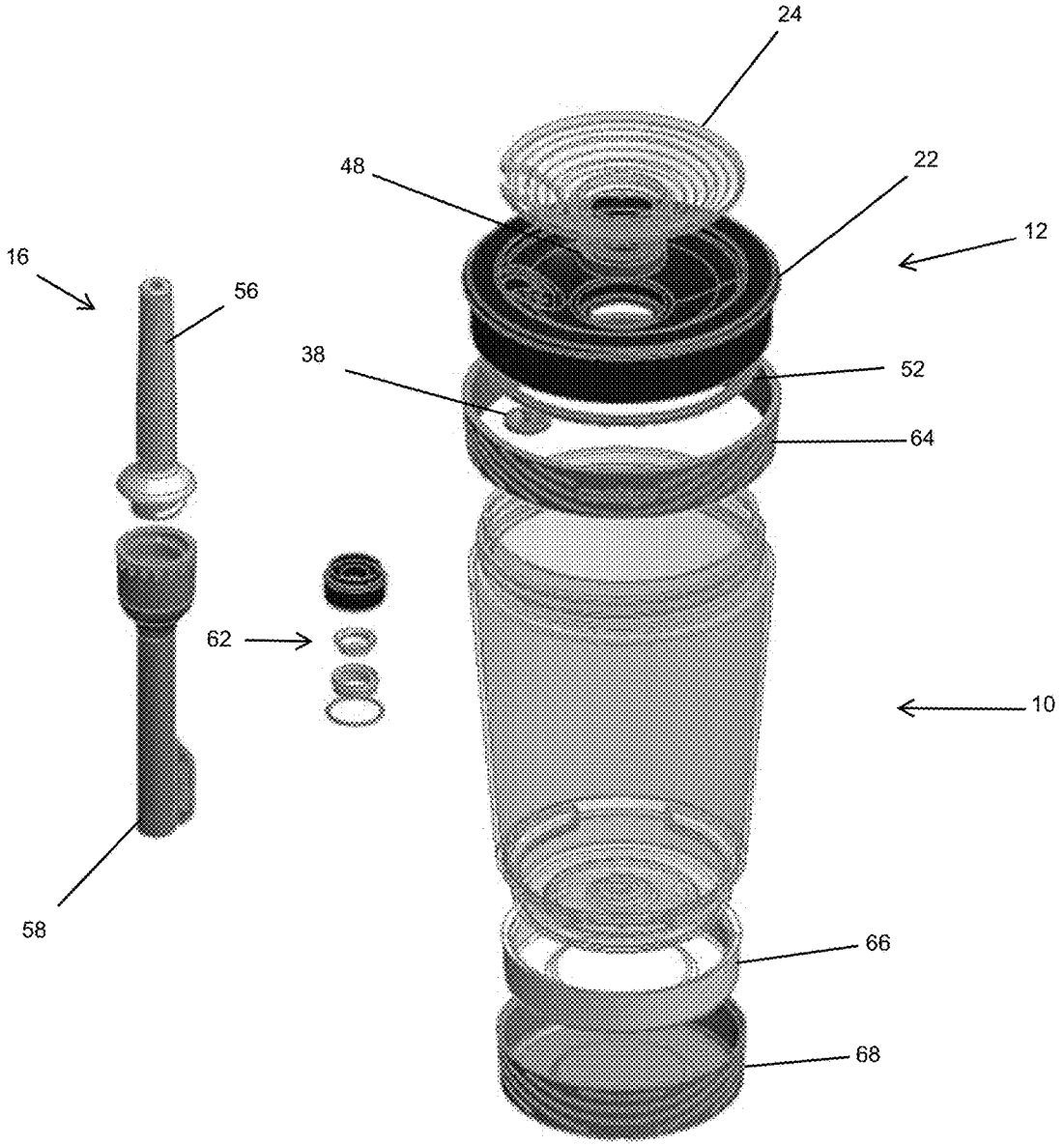
FIG. 3 is an exploded perspective view of the container of FIG. 2.

Turning now to FIGS. 2 and 3, the cover 14 includes a base 22 and a cap 24. The base 22 is generally annular in shape and includes an outer skirt 26 and a center portion 28. The skirt 26 may include an internal threaded portion that cooperates with an external threaded portion of the container 10 to releasably secure the cover 14 to the container 10. The center portion 28 may be generally funnel-shaped, being spaced away from the container 10 a greater distance longitudinally (along a longitudinal axis) near a perimeter of the base 22 than near the center of the base 22. The center portion 28 defines a base opening 30 in a center thereof. The base opening 30 may be surrounded by an annular well 32. The base 22 may include a vent opening 34 and a vent chamber 36 for equalizing pressure between the interior 20 of the container 10 and the atmosphere. The vent chamber 36 may be formed as an inverted well in a bottom surface of the base 22 and the vent chamber 36 may be located adjacent to, and in fluid communication with, the vent opening 34. A vent valve 38 may be disposed within the vent chamber 36. In some embodiments, the vent valve 38 may be an umbrella valve.

The cap 24 may also be substantially funnel-shaped, generally mirroring the center portion 28 of the base 22. The cap 24 may include a series of peaks and valleys on a bottom surface (as illustrated in FIG. 2), that create a series of gas chambers 40 when the cap 24 is attached to the base 22. The gas chambers 40 provide insulation for contents in the interior 20 of the container 10 and the gas chambers 40 also form a gas conduit that fluidly connects the interior 20 of the chamber 10 with the atmosphere through the vent opening 34. The cap 24 includes a cap opening 42 in a center thereof. The cap opening 42 and the base opening 30 are co-axially aligned with one another. The cap opening 42 may include an annular wall 44 that defines an annular surface of the cap opening 42. The annular wall 44 extends downward, toward the base 22. A gap 46 is formed between the cap 24 and the base 22 around the cap opening 42. More specifically, the gap 46 is formed by the annular wall 44 and the annular well 32. The gap 46 is sized and shaped to receive a portion of a grommet 48. The grommet 48 may be made of an elastic or pliable material, such as an elastomer, that is deformable under pressure. The cap 24 and the base 22 compress the grommet 48 so that the grommet 48 deforms inwardly, away from the annular wall 44 and into the cap opening 42 and into the base opening 30. The grommet 48 thereby provides a positive seal when the straw 16 is inserted into the opening 18.

The base 22 may include an annular space 50 between the skirt 26 and the center portion 28. A seal, such as an o-ring 52, may be disposed in the annular space 50 so that the o-ring 52 provides a seal against an upper rim 54 of the container 10 when the cover 14 is attached to the container 10. Thus, the lid assembly 12 provides a liquid seal between the base 22 and the container 10 (via the o-ring 52) and between the base 22 and the straw 16 (via the grommet 48).

The straw 16 may be constructed as a two-piece straw 16 having a first or lower portion 56 and a second or upper portion 58. The first portion 56 and the second portion 58 may be removably connected to one another by, for example, a threaded connection 60. A straw valve 62 may be located between the first portion 56 and the second portion 58. In one embodiment, the straw valve 62 is a one-way cross-slit valve made of flexible silicone. In one aspect, the straw valve 62 may be removable when the first portion 56 and the second portion 58 are separated from one another for easy cleaning. In another aspect, the straw valve 62 is permanently coupled to the first portion 56 or the second portion 58. The straw valve 62 allows fluid to flow from the interior 20 of the container 10 through the straw 16 and out of an upper end 64 of the straw 16 when a consumer sucks on the upper end 64 of the straw 16. This creates a sufficient pressure differential (i.e., a pressure differential in excess of a predetermined opening pressure differential) across the straw valve 62 to deform the flexible silicone, thereby opening a slit in the silicone and allowing fluid to flow through the straw valve 62. However, if the container 10 is tipped over, liquid pressure alone within the straw 16 is not sufficient to deform the flexible silicone and thus to open the slit. As a result, liquid is prevented from flowing through the straw 16 in this case.

The base 22 may include a gripping ring 64 surrounding the skirt 26. The gripping ring 64 may provide a gripping surface for a consumer to grasp. Similarly, the container 10 may include a bottom cap 66 and a gripping cup 68 surrounding the bottom cap 66. The bottom cap 66 and the gripping cup 68 may improve stability of the container 10 when the container 10 is placed upright on a surface.

Figure 4:
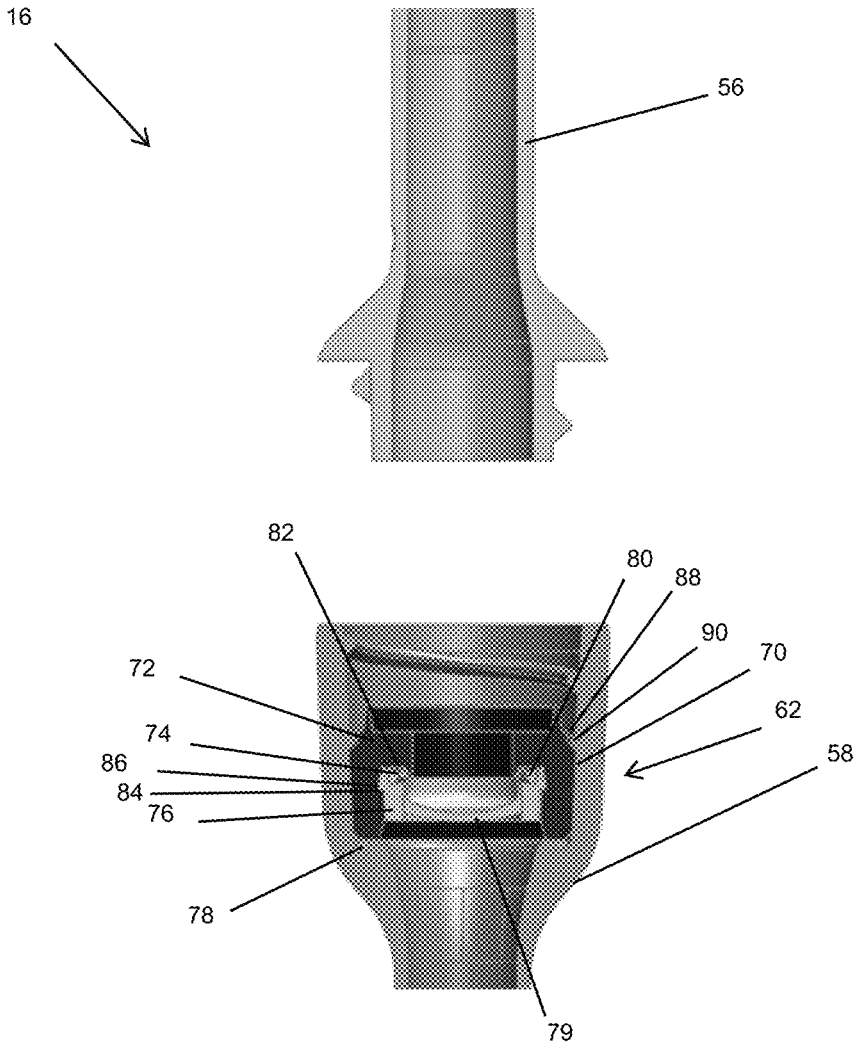
FIG. 4 is a partial cross-sectional view of a straw of the lid assembly of the container of FIG. 2, the straw having upper and lower sections that are separated from one another.
Figure 5:
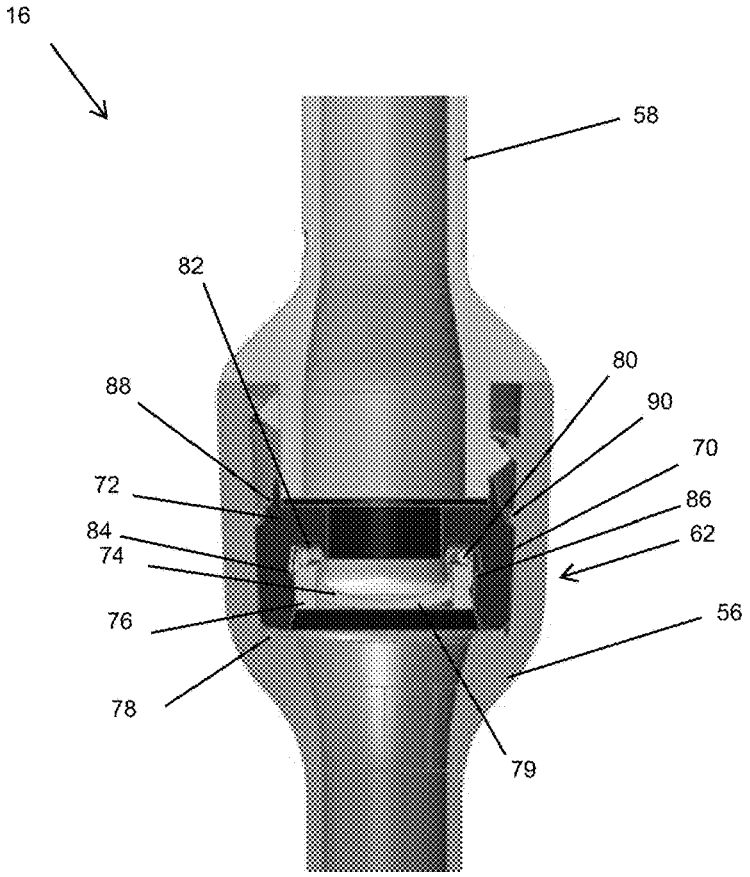
FIG. 5 is a partial cross-sectional view of the straw of FIG. 4, the straw having upper and lower sections that are connected to one another.
Figure 6:
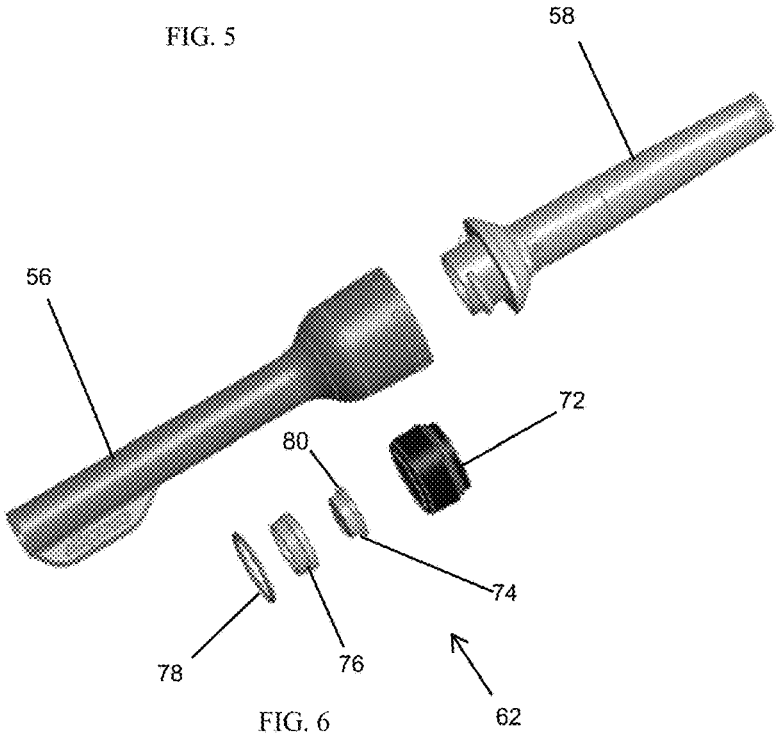
FIG. 6 is an exploded view of the straw of FIGS. 4 and 5.

Turning now to FIGS. 4-6, the straw 16 and straw valve 62 are illustrated in more detail. The first portion 56 of the straw 62 may include a cup-shaped valve chamber 70. The straw valve 62 is disposed within the valve chamber 70. In other embodiments, the valve chamber 70 and straw valve 62 may be located in the second portion 58 of the straw 62.

In the illustrated embodiment, the straw valve 62 includes an annular valve holder 72, a control element 74, a valve retainer 76, and a seal, such as an o-ring 78. The control element 74 includes a center control portion 79 and an annular flange 80. The center control portion 79 may be a pliable disk with a slit, a pliable disk with a cross-cut, or another structure capable of allowing fluid flow in one direction when a sufficient pressure differential is applied. In the exemplified embodiment, the pliable disk is deformable around the slit to produce an opening through the pliable disk when the pressure differential across the pliable disk exceeds the predetermined value. The control element 74 is secured to the valve holder 72 by the valve retainer 76. More specifically, the valve retainer 76 compresses the annular flange 80 of the control element 74 against a recess 82 in the valve holder 72. A locking element, such as a ledge 84, cooperates with a shelf 86 in the valve holder 72 to form a secured connection. In other embodiments, the valve holder 72, the control element 74, and the valve retainer 76 may be separable for easy cleaning. Similarly, the valve holder 72 is releasably secured to the first portion 56 with a securing element, such as a recess 88 that cooperates with a ring 90 on an inner surface of the first portion 56.

Assembling the straw valve 62 may be accomplished first by inserting the control element 74 into the valve holder 72 and thereafter inserting the valve retainer 76 into the valve holder 72 and securing the valve retainer 76 to the valve holder 72 by pushing the ledge 84 into the shelf 86. After the straw valve 62 is assembled, the straw valve 62 may be inserted into the valve chamber 70 of the first portion 56 of the straw 16. The straw valve 62 may be pushed down, into the valve chamber 70 until the ring 90 slides into the recess 88. Finally, once the straw valve 62 is secured to the first portion 56, the second portion 58 may be secured to the first portion 56 twisting one relative to the other, thereby engaging the threaded connection.

The disclosed lid assembly advantageously maintains a drinkable configuration and a no-spill configuration simultaneously so that a user does not need to manipulate any part of the lid assembly. This is especially advantageous for young consumers, such as children and toddlers.

While various embodiments have been described above, this disclosure is not intended to be limited thereto. Variations can be made to the disclosed embodiments that are still within the scope of the appended claims.

What is claimed is:

1. A lid for a liquid container, the lid comprising:

a base having a skirt and a center portion, a base opening being disposed in the center portion;

a cap having a cap opening that is coaxially aligned with the base opening; and a grommet disposed at least partially between the base and the cap, wherein the grommet is compressed between the base and the cap, thereby causing the grommet to extend into the base opening and into the cap opening.

2. The lid of claim 1, wherein the base includes an annular well surrounding the base opening.

3. The lid of claim 2, wherein the cap includes an annular wall that extends towards the base, the annular wall and the annular well forming a gap.

4. The lid of claim 3, wherein the grommet is disposed at least partially within the gap.

5. The lid of claim 1, wherein the base includes a vent opening.

6. The lid of claim 5, wherein a vent chamber is formed in a bottom surface of the base, the vent chamber being adjacent to, and in fluid communication with, the vent opening.

7. The lid of claim 6, further comprising a vent valve disposed in the vent chamber.

8. The lid of claim 7, wherein the vent valve is an umbrella valve.

9. A lid assembly for a liquid container, the lid assembly comprising:

a base having a skirt and a center portion, a base opening being disposed in the center portion;

a cap having a cap opening that is coaxially aligned with the base opening;

a two-piece straw at least partially disposed in the base opening and at least partially disposed in the cap opening, the straw including a valve chamber formed in a first portion of the straw;

a straw valve seated in the valve chamber, the straw valve including a valve holder, a control element, and a valve retainer, the valve retainer securing the control element to the valve holder and a grommet disposed at least partially between the base and the cap, wherein the grommet is compressed between the base and the cap, thereby causing the grommet to extend into the base opening and into the cap opening, and wherein the straw valve prevents fluid from flowing through the straw when a pressure differential across the straw valve is below a predetermined value.

10. The lid assembly of claim 9, wherein the straw includes a second portion that is removably attached to the first portion and the straw valve is disposed between the first portion and the second portion.

11. The lid assembly of claim 9, wherein the valve chamber is cup-shaped.

12. The lid assembly of claim 11, wherein the valve holder is disposed in the valve chamber.

13. The lid assembly of claim 12, wherein the valve holder includes a recess that cooperates with a ring on an inner surface of the first portion to secure the valve holder in the valve chamber.

14. The lid assembly of claim 9, wherein the cap includes a series of peaks and valleys disposed on a bottom surface.

15. The lid assembly of claim 14, wherein the series of peaks and valleys create a series of gas chambers that fluidly connect a vent opening with the atmosphere.

16. A sealed liquid container comprising:

a container body;

a base removably attached to the container body, the base including a vent opening and a base opening;

a cap attached to the base, the cap including a cap opening that is coaxially aligned with the base opening;

a vent chamber formed in a bottom surface of the base, the vent chamber being adjacent to, and in fluid communication with, the vent opening;

a vent valve fluidly connecting the vent opening with an interior of the container body;

a straw disposed in the base opening and in the cap opening, the straw including valve chamber formed in a first portion of the straw;

a one way valve seated in the valve chamber, the one way valve including a valve holder, a control element, and a valve retainer, the valve retainer securing the control element to the valve holder and a grommet disposed at least partially between the base and the cap, wherein the grommet is compressed between the base and the cap, thereby causing the grommet to extend into the base opening and into the cap opening, and wherein the straw allows fluid to flow from the container through the straw when a pressure differential between an interior of the container and an atmosphere exterior to the container is above a predetermined value and the straw prevents fluid from flowing from the container through the straw when the pressure differential is below a predetermined value.

17. The liquid container of claim 16, wherein the valve chamber is cup-shaped.

18. The liquid container of claim 17, wherein the one-way valve comprises a cross-slit silicone valve.

* * * * *